US012514344B2

(12) United States Patent
Ma

(10) Patent No.: US 12,514,344 B2
(45) Date of Patent: Jan. 6, 2026

(54) ZERO PASS WATCH STRAP

(71) Applicant: Maxwell Ma, Seattle, WA (US)

(72) Inventor: Maxwell Ma, Seattle, WA (US)

( * ) Notice: Subject to any disclaimer, the term of this patent is extended or adjusted under 35 U.S.C. 154(b) by 0 days.

(21) Appl. No.: 18/673,531

(22) Filed: May 24, 2024

(65) Prior Publication Data

US 2024/0389722 A1 Nov. 28, 2024

Related U.S. Application Data

(60) Provisional application No. 63/469,031, filed on May 25, 2023.

(51) Int. Cl.
*A44C 5/22* (2006.01)
*A44C 5/00* (2006.01)

(52) U.S. Cl.
CPC ..... *A44C 5/22* (2013.01); *A44C 5/0053* (2013.01)

(58) Field of Classification Search
CPC ..... A44C 5/22; A44C 5/0053
USPC ..... 368/282
See application file for complete search history.

(56) References Cited

U.S. PATENT DOCUMENTS 1,216,322 A * 2/1917 Kales ..... A44C 5/14 224/164
2,266,953 A * 12/1941 Blue ..... A44C 5/0053 156/320
2,420,435 A * 5/1947 Lackow ..... A44C 5/22 24/DIG. 30
5,979,095 A 11/1999 Schneider
2004/0245299 A1* 12/2004 Bertucci ..... A44C 5/0053 224/178
2013/0313294 A1* 11/2013 Bertucci ..... A44C 5/18 224/164

FOREIGN PATENT DOCUMENTS

CH 687952 A5 4/1997
EP 0461547 A1 * 12/1991
EP 1338214 A1 * 8/2003 ..... A44B 11/20
GB 2060759 A * 5/1981 ..... A44C 5/2076

OTHER PUBLICATIONS

Keepers âsewn in or floating? The choice is yours, Toshi Straps, (Jan. 28, 2017), https://toshi-straps.co.uk/keepers-sewn-floating/#:~:text= For%20this%20reason%20I%20would,keeper%20does%20look%20pretty%20good (Year: 2017).*
Vidal (EP 1338214 A1) Machine Translation from PE2E Search (Year: 2003).*

(Continued)

*Primary Examiner* — Edwin A. Leon
*Assistant Examiner* — Kevin Andrew Johnston
(74) *Attorney, Agent, or Firm* — Timothy L Smith

(57) ABSTRACT

The invention provides, in some embodiments, watch straps and watches that preserve the aesthetic features of a "Nato" or military-style watch strap while avoiding the drawbacks associated with the Nato watch strap. The watch straps and watches provide the aesthetic feature of a Nato watch strap without having extra layers of the watch strap between the watch case and the wrist of the wearer.

23 Claims, 7 Drawing Sheets

(56) References Cited

OTHER PUBLICATIONS

Phenomenato premium NATO straps (Review), Kaminsky Blog (Sep. 9, 2017), https://kaminskyblog.com/2017/09/25/phenomenato-premium-nato-straps-review/ (Year: 2017).*
Keepers â sewn in or floating? The choice is yours, Toshi Straps, (Jan. 28, 2017), https://toshi-straps.co.uk/keepers-sewn-floating/#:~:text=For%20this%20reason%201%20wouldkeeper%20does%20look%20pretty%20good (Year: 2017).*
EP-1338214-A1 Machine Translation from PE2E Search (Year: 2003).*
Written Opinion of the International Searching Authority for related application PCT/US2024/030958.
Jason Rushin, "Comparing 3 Elastic Watch Straps: Budget Choices or Budget be Damned?" https://twobrokewatchsnobs.com/comparing-3-elastic-watch-straps-budget-choices-or-budget-be-damned/, 28 pages, Oct. 3, 2022, retrieved on Jun. 1, 2024.
Nick Mankey Designs web page, https://nickmankeydesigns.com/, 12 pages, Jul. 20, 2021, retrieved from Internet Archive Wayback Machine, https://web.archive.org/web/20210720065740/https://nickmankeydesigns.com/hook-straps on Jun. 6, 2024 (note: some photographs were not retrievable from the archive).
Erika's Originals web page, https://erikasoriginals.com/, 9 pages, May 20, 2023, retrieved from Internet Archive Wayback Machine, https://web.archive.org/web/20230520084417/https://erikasoriginals.com/ on Jun. 1, 2024.
Apple watch band web page, https://www.apple.com/shop/watch/bands, 28 pages, May 23, 2023, retrieved from Internet Archive Wayback Machine, https://web.archive.org/web/20230523161019/https://www.apple.com/shop/watch/ bands on Jun. 6, 2024.

* cited by examiner

ZERO PASS WATCH STRAP

CROSS-REFERENCE TO RELATED APPLICATION

This application claims the benefit of U.S. Provisional Application No. 63/469,031, filed May 25, 2023.

BACKGROUND OF THE INVENTION

The military style watch strap—also referred to as the "Nato" strap—is a popular way to secure a watch to the wearer, utilizing a single strap rather than two strap ends attached individually to either end of the watch. This style of watch strap creates a unique and popular aesthetic. There are two existing types of military style watch straps: single pass and dual/double pass. The number of "passes" refers to the layers of material routed underneath the watch when worn. A major drawback of existing Nato watch straps is that the material underneath the watch lifts it above the wrist, adding unwanted height to the watch when worn.

SUMMARY OF THE INVENTION

The invention provides, in some embodiments, a watch strap configured to be worn about a member of a living body (for example, a wrist). The watch strap includes a non-elastic flexible material having a first end and a second end, and a clasp attached to the first end of the flexible material. The watch strap has a length of at least 13 inches. In some embodiments, the length of the strap is approximately twice the circumference of the member along a longest dimension of the watch strap. In some embodiments, the length of the watch strap is at least 14 inches, or at least 15 inches. The watch strap, in some embodiments, is a single-piece watch strap. In some embodiments, the watch strap is adjustable. For example, in some embodiments, the strap is adjustable through use of a pin buckle as the clasp and providing two or more adjustment holes in the flexible material. In some embodiments, the watch strap also includes at least a first keeper positioned on the flexible material, with the first keeper defining an aperture that is proximate to the bottom surface of the flexible material.

In some embodiments, the invention provides a watch strap that is configured to be worn about a member of a living body (for example, a wrist), wherein the watch strap includes a flexible material having a) a top surface and a bottom surface, and b) a first end and a second end. The watch strap also includes a clasp attached at the first end of the flexible material, wherein the clasp is oriented with the top surface of the flexible material, and at least a first keeper positioned on the flexible material, wherein the first keeper defines an aperture that is proximate to the bottom surface of the flexible material. In some embodiments, the first keeper is positioned approximately at a midpoint of the flexible material. In some embodiments, the first keeper is removably positioned on the flexible material, and in other embodiments, the first keeper is permanently attached to the flexible material. In some embodiments, the watch strap is adjustable. As one example, the strap can include a pin buckle as the clasp, with two or more adjustment holes in the flexible material, with the first keeper positioned on the flexible material between the clasp and the two or more adjustment holes. In some embodiments, the watch straps can also include one or more additional keepers attached to the flexible material in proximity to the clasp, with the one or more additional keepers defining an aperture that is proximate to the top surface of the flexible material. In some embodiments, the length of the watch strap is at least 13 inches. In some embodiments, the length of the watch strap is approximately twice the circumference of the member along a longest dimension of the watch strap. In additional embodiments, the length of the watch strap is at least 14 inches, or at least 15 inches.

The invention provides, in some embodiments, a watch that has a watch body and a watch strap that is attached to the watch body. The watch body has a top surface that typically includes a watch face, and a bottom surface opposite the top surface. The watch strap includes a flexible material that has a first end and a second end and is configured to be worn about a member of a living body, for example, a wrist. In some embodiments, neither the first end nor the second end of the flexible material is attached to the watch body and no portion of the flexible material passes between the bottom surface of the watch body and the member when the watch is worn on the living body. In some embodiments, the watch body has a first attachment mechanism and a second attachment mechanism, which, in some embodiments, is opposite the first attachment mechanism, and the flexible material doubles back upon itself at each of the first and second attachment mechanisms so that two layers of the flexible material extend from each attachment point away from the watch body. In some embodiments, two layers of the flexible material wrap around substantially all of the circumference of the member that is not in contact with the watch body when the watch is worn on the living body. In some embodiments, the watch strap is a single-piece watch strap. In some embodiments, the length of the watch strap is at least about 13 inches. In some embodiments, the watch strap includes at least a first keeper positioned on the flexible material, wherein the flexible material defines an aperture that is proximate to the bottom surface of the flexible material.

In some embodiments, the invention provides a watch that includes a watch body and a watch strap, in which the watch body has a top surface and a bottom surface opposite the top surface. In some embodiments, the top surface of the watch body includes a watch face. The watch also includes a first attachment mechanism and a second attachment mechanism that are attached to the watch body. The watch also includes a watch strap that includes a flexible material that passes through each of the first attachment mechanism and the second attachment mechanism and doubles back upon itself at each of the first and second attachment mechanisms so that two layers of the flexible material extend away from the watch body from each of the first attachment mechanism and the second attachment mechanism. In some embodiments, no portion of the flexible material passes between the bottom surface of the watch body and the member when the watch is worn on a member (e.g., a wrist) of a living body. In some embodiments, two layers of the flexible material pass around substantially all of the circumference of the member that is not in contact with the watch body. In some embodiments, the watch strap is a single-piece watch strap. In some embodiments, the watch strap includes a clasp and a flexible material that has a top surface that is oriented with the clasp, wherein a first portion of the top surface of the flexible material faces away from the member of the living body, a second portion of the top surface of the flexible material faces towards the member of the living body, and a third portion of the top surface of the flexible material faces away from the member of the living body. In some embodiments, the watch strap comprises at least a first keeper positioned on the flexible material, wherein the first keeper defines an aperture that is proximate to the bottom surface of the flexible material. In some embodiments, the length of the watch strap is at least about 13 inches.

DETAILED DESCRIPTION OF THE INVENTION

The invention provides, in some embodiments, a watch strap that retains the unique and popular aesthetic of the "Nato"-style or military style watch strap, while eliminating the major drawbacks associated with the previously available watch straps.

Watch Straps

Figure 1:
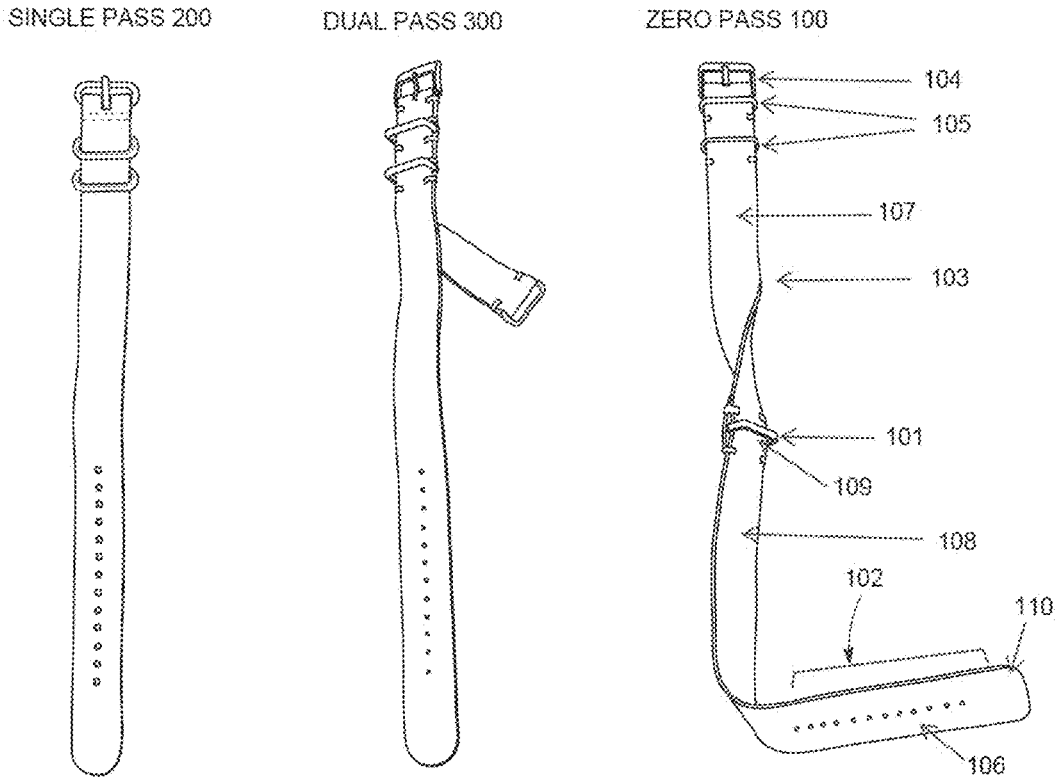
FIG. 1 shows a top view of an embodiment of a "Zero Pass" watch strap of the invention 100, as well as a "single pass" watch strap 200 and a "dual pass" Nato-style watch strap 300.

In some embodiments, the watch strap of the invention 100 includes a flexible material 103 and a clasp 104 attached to a first end of the flexible material, as shown in FIG. 1. The second end 110 of the flexible material is sometimes referred to as the "free end." Also shown in FIG. 1 are a Nato-style or dual pass strap 300 and a single pass strap 200. In some embodiments, the watch strap of the invention is distinguished from the single pass and dual pass straps in that the watch straps of the invention have additional length 102 compared to the single pass and dual pass straps. In some embodiments, the length of the watch strap of the invention in its longest dimension is approximately twice the circumference of the body member (e.g., a wrist) about which the strap is to be worn. The average wrist size for men is 6.5-7.2 inches (16.5-18.3 cm), and for women it is 5.7-6.2 inches (14.6-15.7 cm). Accordingly, in some embodiments, the watch strap of the invention is at least 13 inches in length. In some embodiments, the watch strap is at least 14 inches in length, and in further embodiments, the watch strap of the invention is at least 15 inches in length along its longest dimension. In some embodiments, the watch strap of the invention is between 13 and 19 inches in length. In some embodiments, the length of the watch strap is between 14 and 18 inches, and in some embodiments, the length of the watch strap is between 15 and 16 inches.

The watch strap of the invention can be made from any flexible material. Examples of suitable materials include fabrics such as canvas, nylon, or other woven textiles. Leather, silicone, rubber, plastic, fluoroelastomers (FKM), Perlon®, and other materials are also suitable, as are mesh materials made of, for example, stainless steel or other material.

In some embodiments, the flexible material used in the watch straps of the invention is non-elastic. The term "elastic" refers to any material which, upon application of a biasing force, is stretchable, that is, elongatable, to a stretched, biased length which is at least about 125 percent, of its relaxed, unbiased length, and which, will recover at least 40 percent of its elongation upon release of the stretching, elongating force. A hypothetical example which would satisfy this definition of elastic material would be a one inch sample of a material which is elongatable to at least 1.25 inches and which, upon being elongated to 1.25 inches and released, will recover to a length of not more than 1.15 inches. Many elastic materials may be stretched by much more than 25 percent of their relaxed length, for example, 100 percent or more, and many of these will recover to substantially their original relaxed length, for example, to within 105 percent of their original relaxed length, upon release of the stretching, elongating force. A "non-elastic" material is thus a material that does not fall within the definition of "elastic."

In some embodiments, the watch straps of the invention are adjustable so that, for example, one can adjust the strap to fit different wrist sizes or to change how tight or loose the strap feels when worn.

Many types of watch clasp are suitable for use in the watch straps of the invention. One suitable clasp type is the pin buckle 104, also known as a tang buckle, as shown in FIG. 1. A pin buckle, which is often composed of a frame and a pin or prong (referred to herein collectively as a pin buckle 104), is commonly made of stainless steel or a similar material, although other materials are also suitable. Watch straps of the invention that include a pin buckle type of clasp also typically have one or more adjustment holes 106 near the opposite end of the flexible material to which the pin buckle is attached. The watch strap is secured to the wrist by inserting the pin of the pin buckle into one of the adjustment holes. One advantage of the pin buckle type of clasp is that the watch strap is adjustable, simply by choosing a different adjustment hole into which to insert the pin of the buckle. Other suitable clasp types include, for example, hook-and-loop (e.g., Velcro®), and a folding deployant clasp, among others. The clasp is attached to the flexible material by any suitable attachment mechanism, including a spring bar, a screw, sewn in with thread, or other mechanisms known in the art.

In other embodiments, the invention provides watch straps that are configured to be worn about a member (e.g., a wrist) of a living body and include a flexible material having a top surface 107 and a bottom surface 108 as shown in FIG. 1. A clasp 104 is attached to a first end of the flexible material, oriented with the top surface of the flexible material. The top surface of the flexible material is that surface which, with reference to the portion of the flexible material that is immediately adjacent to the clasp, faces away from the member (e.g., wrist) when the clasp is fasted to secure the strap about the member. The clasp is said to be "oriented" with the top surface of the material if, with the top surface facing away from the wrist, one can fasten and unfasten the clasp.

These embodiments of the watch strap can also include at least a first keeper or strap retainer 101 positioned on the flexible material, where the first keeper defines an aperture 109 that is adjacent to the bottom surface 108 of the flexible material (FIG. 1). Suitable keepers are, in some embodiments, substantially oval, rectangular or racetrack-shaped in configuration and form an aperture which is designed to receive an end of the flexible material. As explained in more detail below, the end of the flexible material that is opposite the clasp is fed through this first keeper or keepers, which retain the flexible material against the bottom surface. Suitable materials for use as keepers are known to those of skill in the art and include, for example, stainless steel, titanium, bronze, wood, plastic, synthetic polymers, and other materials. In some embodiments, the first keeper or keepers are removably attached to the flexible material. For example, in some embodiments, the keeper is slidably positioned on the flexible material so that the keeper can be positioned on the flexible material by sliding the free end of the flexible material through the keeper. As explained in more detail below, this type of attachment can facilitate attachment of the strap to a watch case. In other embodiments, the first keeper or keepers are permanently attached to the flexible material.

The watch straps of the invention, are, in some embodiments, single-piece watch straps. "Single-piece," as used herein, means that the watch strap does not include two separate components, one of which attached to each side of a watch case. The term "single-piece" does not require that the watch strap be constructed of a single piece of material (e.g., the flexible material can be constructed of one or more pieces of the same or a different material and still be considered a "single-piece" watch strap).

Attachment Process for Watch Straps

Figure 3:
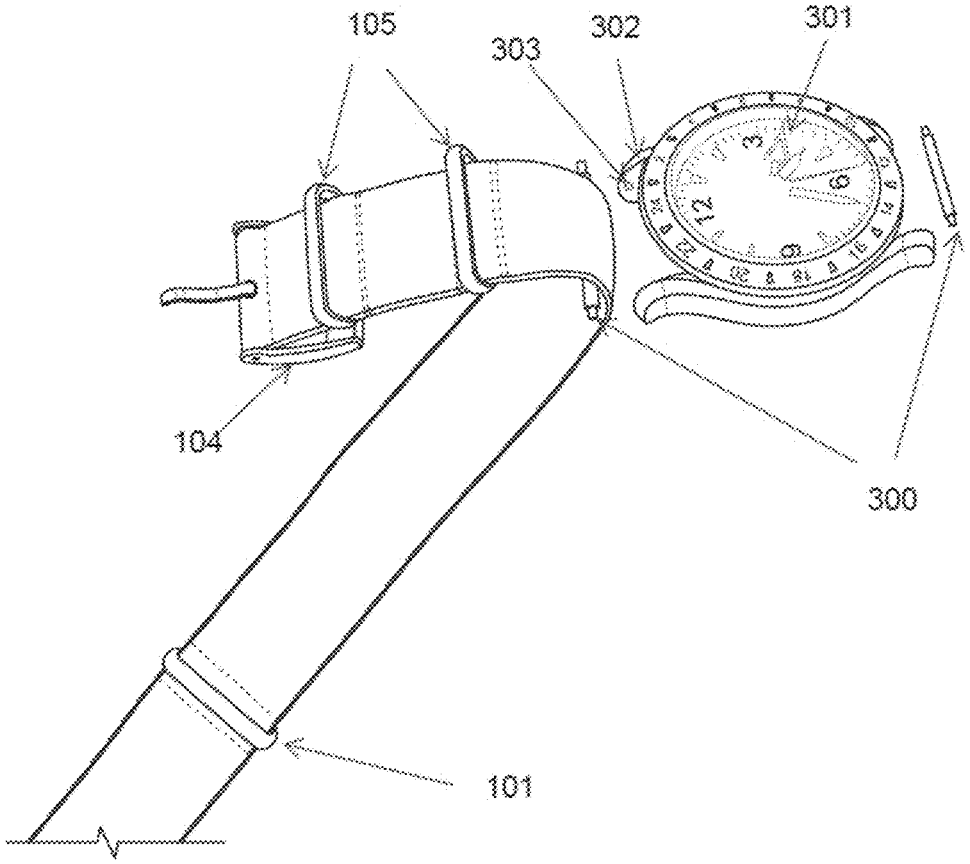
FIG. 3 shows a first step of attaching a "Zero Pass" watch strap to a watch case.

FIGS. 3-10 illustrate steps by which one can attach some embodiments of the watch straps of the invention to a watch body. The watch body has a first attachment mechanism and a second attachment mechanism. For purposes of illustration, the figures show attachment of the strap to a watch case that has spring bars 300 and lugs 302 as the attachment mechanism, but other types of attachment mechanism are also suitable. FIG. 3 shows a first step of attaching an example of a "Zero Pass" watch strap of the invention to a watch body that has a spring bar attachment mechanism. The spring bar 300 is removed from one of the attachment mechanisms, often the twelve o'clock attachment mechanism, which is the attachment mechanism that is proximal to the twelve o'clock position of the watch face. The six o'clock attachment mechanism may also be used for the initial attachment of the strap to the watch case. The watch strap is placed between the lugs 302 of the attachment mechanism and the spring bar 300, and the spring bar is inserted into each of a pair of holes 303 (typically one hole on each of the two opposing lugs, but only one of the holes is shown) to attach the strap to the first attachment mechanism of the watch body. The top surface of the flexible material is aligned with the top surface 301 of the watch case (e.g., the surface of the watch case that typically includes the watch face). The spring bar is usually positioned near the first end of the flexible material, to which the clasp is attached. If the watch strap includes a first keeper 101 that is oriented with the bottom surface of the watch strap as shown in FIG. 3, the removed spring bar is positioned between the clasp end of the watch strap and the keeper 101. Although the figure shows the spring bar removed from both attachment mechanisms, it is not necessary to remove the spring bar from both attachment mechanisms to attach the strap; removal of the spring bar from one attachment mechanism is sufficient. In embodiments in which the first keeper 101 is removably attached to the watch strap, one can avoid having to remove the spring bar from, or otherwise disassemble, either attachment mechanism. One can simply pass the second end 110 of the flexible material (the end to which the clasp is not attached, referred to herein as the "free end") through the attachment mechanism while the first keeper is removed from the strap, and then position the first keeper on the watch strap after passing the second end of the flexible material through the attachment mechanism. If the first keeper 101 is permanently attached to the strap, it is necessary to disassemble one of the two attachment mechanisms (e.g., by removing a spring bar) to attach the strap.

Figure 4:
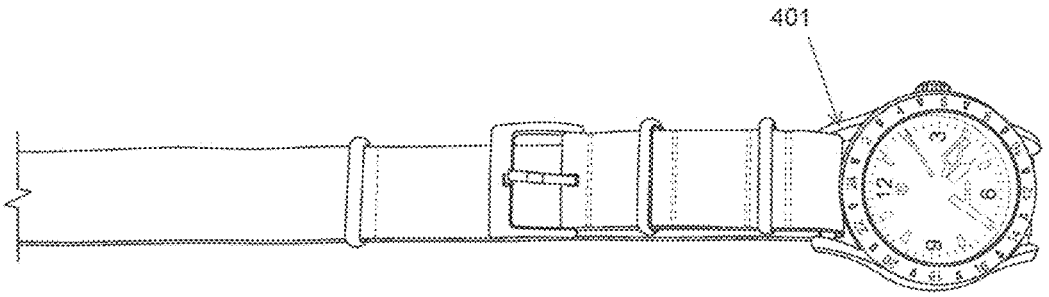
FIG. 4 shows a "Zero Pass" watch strap attached to the 12 o'clock attachment mechanism of a watch case.
Figure 5:
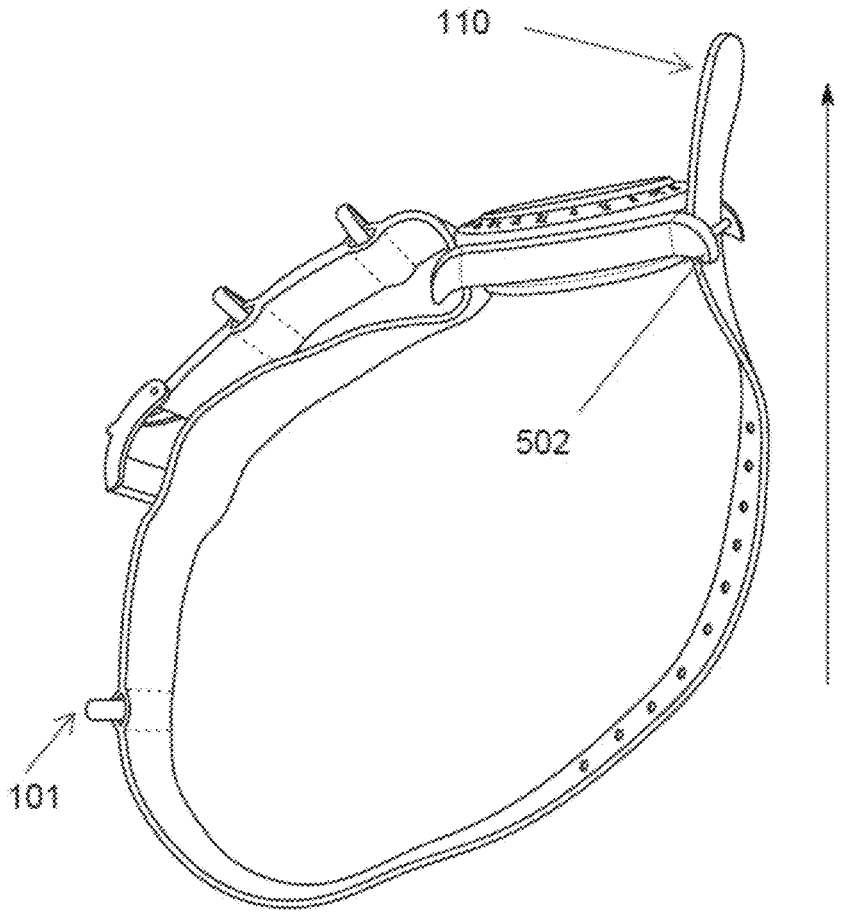
FIG. 5 shows a second step of attaching a "Zero Pass" watch strap to a watch case, in which the end of the strap is passed through the 6 o'clock attachment mechanism of a watch case.
Figure 6:
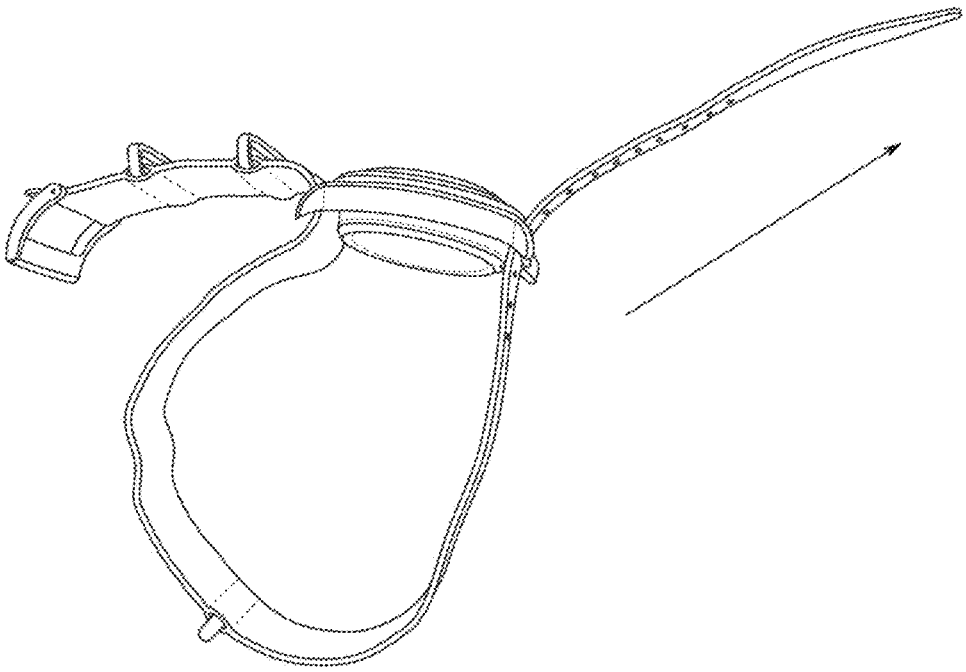
FIG. 6 shows a "Zero Pass" watch strap being pulled further through the 6 o'clock attachment mechanism of a watch case.
Figure 7:
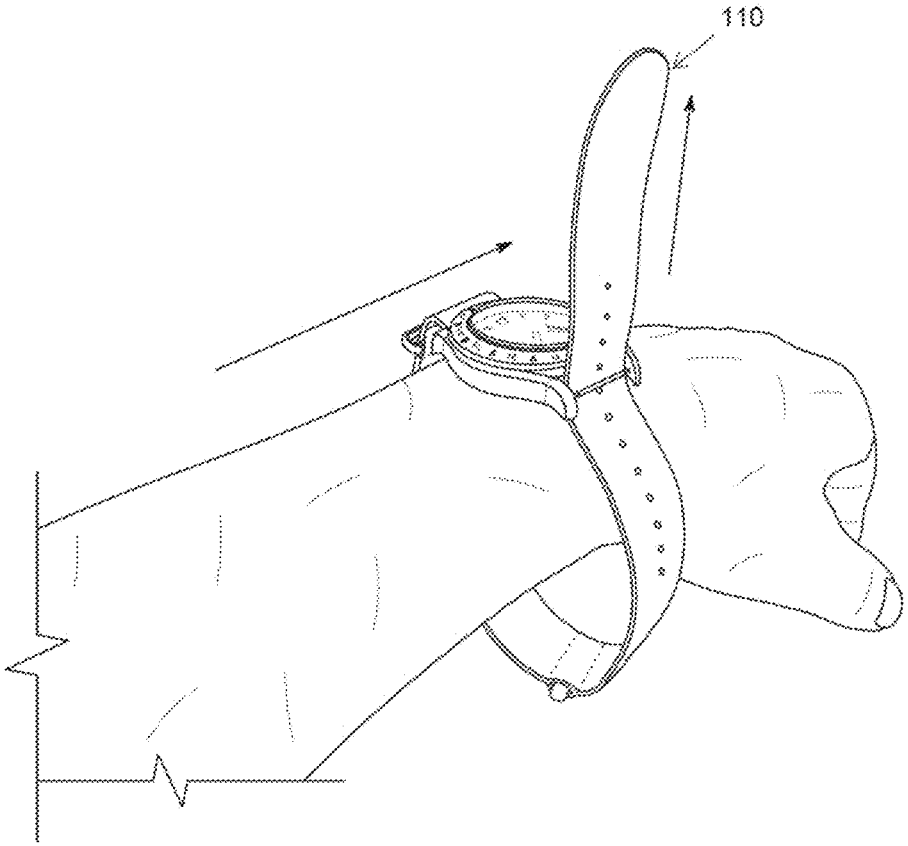
FIG. 7 shows a "Zero Pass" watch strap being placed on a wrist of a watch wearer.
Figure 8:
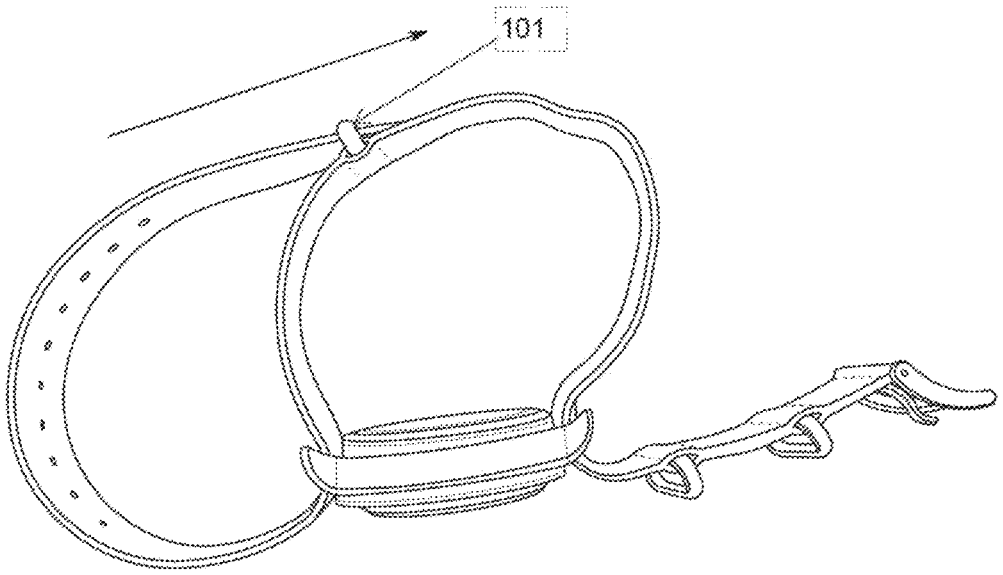
FIG. 8 shows the end of a "Zero Pass" watch strap being passed through a keeper on the strap. For clarity, the wrist of the wearer is not shown.

FIG. 4 shows a watch strap attached to the watch body at the first attachment mechanism of the watch body, in this illustration, the twelve o'clock attachment mechanism 401. In FIG. 5, the free end 110 of the flexible material is passed through the second attachment mechanism 502 of the watch body (in this case, the six o'clock attachment mechanism). FIG. 6 shows the free end 110 of the flexible material pulled further through the second attachment mechanism. FIG. 7 shows the watch being placed on a wrist, after which the free end 110 of the flexible material is pulled further through the second attachment mechanism. As shown in FIG. 8, the free end 110 of the flexible material is then inserted through the first keeper 101. For clarity, the wrist of the wearer is not shown in this figure.

Figure 9:
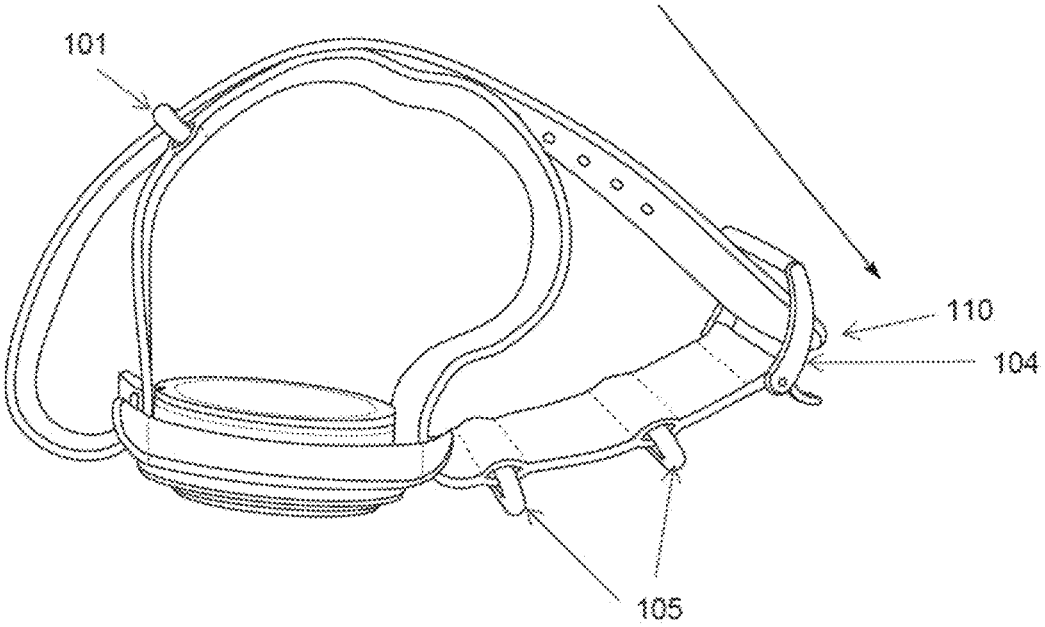
FIG. 9 shows the next step of a watch wearer putting on a watch using a "Zero Pass" watch strap, in which the end of the strap is passed through a pin buckle. Again, for clarity, the wrist of the wearer is not shown.
Figure 10:
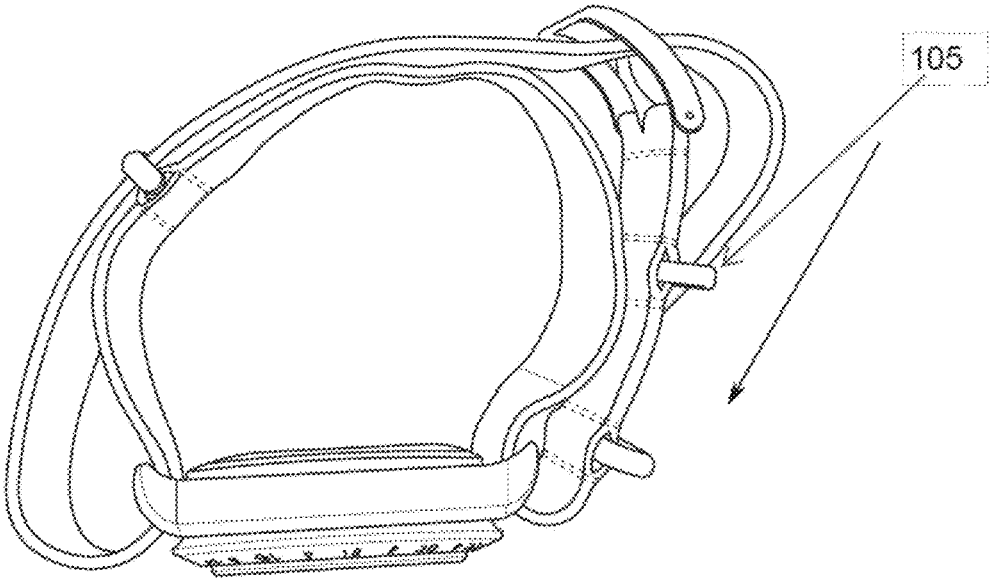
FIG. 10 shows a further step of a watch wearer putting on a watch that has a "Zero Pass" watch strap, in which the end of the strap is passed through additional keepers that are in proximity to a pin buckle. For clarity, the wrist of the wearer is not shown.

As shown in FIG. 9, the free end 110 of the flexible material is then inserted through the clasp 104. A pin buckle is illustrated, although different types of clasp are also suitable. The pin of the pin buckle is then inserted into one of the adjustment holes, and the free end 110 of the flexible material is passed through one or more additional keepers 105, completing the attachment of the strap to the watch body (FIG. 10). Again, the wrist of the wearer is not shown in these figures.

Watches

The invention also provides watches that include a "zero pass" watch strap. In some embodiments, the watches of the invention include a watch body that has a top surface and a bottom surface that is opposite to the top surface. The top surface typically includes a watch face. The watch body also typically includes two attachment mechanisms for attaching a watch strap to the watch body. Often, one attachment mechanism is at the "twelve o'clock" side of the watch body, which is the side nearest to the twelve o'clock position on the watch face, and a second attachment mechanism at the six o'clock side of the watch body. One example of an attachment mechanism includes a pair of lugs 302 that are attached to the watch body, and a spring bar 300 that is inserted into holes 303 formed in the lugs (FIG. 3). Other attachment mechanisms are known to those of skill in the art, and include, for example, screws that attach to the lugs, a wire soldered onto the watch case, fixed lugs in which an opening is formed in an extension of the watch case to allow a flexible strap to pass through the opening.

In some embodiments, the watches of the invention include a watch strap that is attached to the watch body. The watch strap has a first end and a second end and is configured to be worn about a member of a living body (e.g., a wrist).

Figure 2:
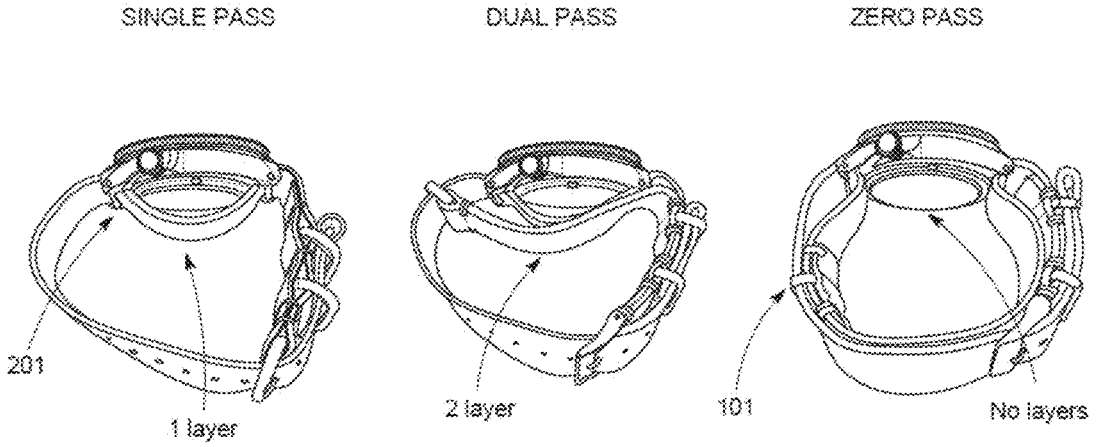
FIG. 2 shows an embodiment of the "Zero Pass" watch strap attached to a watch, as well as a "single pass" watch strap and a "dual pass" Nato-style watch strap, each attached to a watch.

The strap, in some embodiments, is attached to the watch body so that neither the first end nor the second end of the watch strap is attached to the watch body, and no portion of the watch strap passes between the bottom surface of the watch body and the member when the watch is worn on the living body. As shown in FIG. 2, this embodiment of the watch thus avoids a major drawback of the dual pass (also known as the Nato-style or military style) watch strap, as well as the single pass strap, which is that the extra layer or layers of material between the bottom surface of the watch body and the wearer's wrist with the dual pass and single pass straps lifts the watch above the wrist and adds unwanted height to the watch when worn.

The invention also provides, in other embodiments, a watch having a watch body that has a top surface that includes a watch face, and a bottom surface that is opposite to the top surface. The watch body also has a first attachment mechanism proximal to the twelve o'clock portion of the watch face, and a second attachment mechanism that is proximal to the six o'clock portion of the watch face. The watch also includes a watch strap that includes a flexible material that passes through each of the attachment mechanisms and doubles back upon itself at each attachment mechanism so that two layers of the flexible material extend from each attachment mechanism away from the watch body. When the watch is worn on a living body, no portion of the flexible material passes between the bottom surface of the watch body and the member. In some embodiments, two layers of the flexible material pass around substantially all of the circumference of the member that is not in contact with the watch body when the watch is worn.

In additional embodiments, the flexible material has a top surface that is oriented with the clasp. A first portion of the top surface that is proximal to the clasp faces away from the member of the living body. A second portion of the top surface, which is proximal to the other end of the flexible material, also faces away from the member of the living body. A third portion of the top surface, which lies between the first and second portions, faces towards the member when the watch is worn.

The invention claimed is:

1. A watch strap configured to be worn about a member of a living body, wherein the watch strap comprises:

a) a non-elastic flexible material having a top surface and a bottom surface and a first end and a second end, and b) a clasp attached to the first end of the flexible material, wherein the clasp is oriented with the top surface of the flexible material and the watch strap further comprises at least a first keeper permanently attached to the flexible material, wherein the first keeper defines an aperture between the keeper and the bottom surface of the flexible material that extends outward from the bottom surface of the flexible material; and wherein: (i) the length of the watch strap is at least 13 inches, (ii) the clasp comprises a pin buckle, and (iii) the flexible material comprises two or more adjustment holes.

2. The watch strap of claim 1, wherein the length of the watch strap is approximately twice the circumference of the member along a longest dimension of the watch strap, wherein the member is a wrist.

3. The watch strap of claim 1, wherein the length of the watch strap is at least 14 inches.

4. The watch strap of claim 3, wherein the length of the watch strap is at least 15 inches.

5. The watch strap of claim 1, wherein the watch strap is a single-piece watch strap.

6. The watch strap of claim 1, wherein the watch strap is adjustable.

7. The watch strap of claim 1, wherein the first keeper is positioned approximately at a midpoint of the flexible material.

8. A watch strap configured to be worn about a wrist, wherein the watch strap comprises:

a) a flexible material having:

a top surface and a bottom surface, and a first end and a second end, wherein the flexible material comprises two or more adjustment holes;

b) a clasp attached at the first end of the flexible material, wherein: (i) the clasp is oriented with the top surface of the flexible material, and (ii) the clasp comprises a pin buckle; and c) at least a first keeper permanently attached to the flexible material, wherein the first keeper defines an aperture between the keeper and the bottom surface of the flexible material that extends outward from the bottom surface of the flexible material.

9. The watch strap of claim 8, wherein the first keeper is positioned approximately at a midpoint of the flexible material.

10. The watch strap of claim 8, wherein the watch strap is adjustable.

11. The watch strap of claim 8, wherein the first keeper is positioned on the flexible material between the clasp and the two or more adjustment holes.

12. The watch strap of claim 8, wherein the watch strap further comprises one or more additional keepers attached to the flexible material wherein each of the one or more additional keepers defines an aperture between the keeper and the top surface of the flexible material that extends outward from the top surface of the flexible material.

13. The watch strap of claim 8, wherein the watch strap is a single-piece watch strap.

14. The watch strap of claim 8, wherein the length of the watch strap is at least 13 inches.

15. The watch strap of claim 8, wherein the watch strap has a length that is approximately twice the circumference of the wrist along a longest dimension of the watch strap.

16. A watch comprising a watch body and a watch strap, wherein:

a) the watch body comprises a top surface that comprises a watch face, and a bottom surface opposite the top surface; and b) the watch strap comprises a flexible material having a first end and a second end, wherein the watch strap is attached to the watch body and is configured to be worn about a wrist, wherein (i) the watch strap comprises a clasp that comprises a pin buckle, and (ii) the flexible material comprises two or more adjustment holes, wherein: x) neither the first end nor the second end of the flexible material is attached to the watch body and no portion of the flexible material passes between the bottom surface of the watch body and the member when the watch is worn on the wrist; and y) the flexible material comprises a top surface and a bottom surface, and the watch strap comprises at least a first keeper permanently attached to the flexible material, wherein the first keeper defines an aperture between the keeper and the bottom surface of the flexible material that extends outward from the bottom surface of the flexible material.

17. The watch of claim 16, wherein the watch body comprises a first attachment mechanism and a second attachment mechanism, and the flexible material passes through each of the first and second attachment mechanisms and doubles back upon itself at each attachment mechanism, so that two layers of the flexible material extend from each attachment point away from the watch body.

18. The watch of claim 17, wherein the two layers of the flexible material wrap around substantially all of the circumference of the wrist that is not in contact with the watch body when the watch is worn on the wrist.

19. The watch of claim 16, wherein the watch strap is a single-piece watch strap.

20. The watch of claim 16, wherein the length of the watch strap is at least 13 inches.

21. A watch comprising a watch body and a watch strap, wherein:

a) the watch body comprises a top surface and a bottom surface opposite the top surface;

b) the watch comprises a first attachment mechanism and a second attachment mechanism, wherein the first attachment mechanism and the second attachment mechanism are attached to the watch body; and c) the watch strap comprises a flexible material, wherein the flexible material passes through each of the first attachment mechanism and the second attachment mechanism and doubles back upon itself at each of the first and second attachment mechanisms, so that two layers of the flexible material extend away from the watch body at each of the first attachment mechanism and the second attachment mechanism, wherein (i) the watch strap comprises a clasp that comprises a pin buckle, and (ii) the flexible material comprises two or more adjustment holes;

wherein: x) the flexible material comprises a top surface and a bottom surface, and the watch strap comprises at least a first keeper permanently attached to the flexible material, wherein the first keeper defines an aperture between the keeper and the bottom surface of the flexible material that extends outward from the bottom surface of the flexible material; and y) when the watch is worn on a wrist, no portion of the flexible material passes between the bottom surface of the watch body and the wrist.

22. The watch of claim 21, wherein two layers of the flexible material pass around substantially all of the circumference of the wrist that is not in contact with the watch body.

23. The watch of claim 21, wherein the length of the watch strap is at least 13 inches.

* * * * *